US005368381A

United States Patent [19]

Mandel

[11] Patent Number: 5,368,381

[45] Date of Patent: Nov. 29, 1994

[54] REFRIGERATOR CABINET CONSTRUCTION

[75] Inventor: Sheldon Mandel, Galesburg, Ill.

[73] Assignee: Maytag Corporation, Newton, Iowa

[21] Appl. No.: 15,383

[22] Filed: Feb. 9, 1993

[51] Int. Cl.[5] ..... F25D 23/00

[52] U.S. Cl. ..... 312/406.2

[58] Field of Search ..... 312/406.2, 406, 401; 49/DIG. 1; 220/9, 9 G

[56] References Cited

U.S. PATENT DOCUMENTS

| | | | |
|---|---|---|---|
| 2,758,741 | 8/1956 | Saunders | 312/406.2 X |
| 2,760,301 | 8/1956 | Derr et al. | 312/406.2 X |
| 3,835,660 | 9/1974 | Franck | 312/406.2 X |
| 4,330,310 | 5/1982 | Tate, Jr. et al. | 403/401 X |

*Primary Examiner*—Kenneth J. Dorner
*Assistant Examiner*—Nancy Mulcare
*Attorney, Agent, or Firm*—Bacon & Thomas

[57] ABSTRACT

A refrigerator cabinet construction is disclosed wherein the exterior cabinet has a flange extending around an open side, which flange defines a channel. A breaker strip having a first portion engageable with a flange on the inner liner has a resilient portion which is snap-fit into the channel defined in the flange of the exterior cabinet. The snap-fit construction securely holds the breaker strip attached to the cabinet, while the engagement between the breaker strip and the inner liner is such that it will accommodate a wide variance in manufacturing tolerances. At the same time, however, the breaker strip accurately aligns the liner within the refrigerator cabinet. The breaker strip also defines a closed periphery channel which extends substantially along the entire length of the breaker strip and which is adapted to receive a magnetic door closing strip.

6 Claims, 2 Drawing Sheets

REFRIGERATOR CABINET CONSTRUCTION

BACKGROUND OF THE INVENTION

This invention relates to a construction for a refrigerator cabinet, such as domestic refrigerators and freezers, and encompasses a breaker strip to attach the internal liner to the exterior cabinet.

The typical domestic refrigerator or freezer is constructed having an exterior cabinet, generally made of metal, having an open side and a liner, typically made of plastic, adapted to fit within the exterior cabinet and define the interior surfaces of the refrigerator or freezer compartment. The liner is spaced from the exterior cabinet and insulation material is inserted in this space. A breaker strip is utilized to interconnect the front faces of the interior liner and the exterior cabinet and to assist in holding these elements in a spaced relationship until the insulating material can be placed between them.

Many types of breaker strips are known in the art and have various means to engage the inner liner and the exterior cabinet. Typically, these means include forming the breaker strip to engage flanges on the liner and the exterior cabinet. In many cases, however, the engagement between the breaker strip and either the liner or the exterior cabinet does not become secure until the insulation material has been inserted.

Current refrigerator cabinet designs require that the inner liner be considerably distorted in order to insert the flanges of the liner into the mating portion of the exterior cabinet. The distortion of the inner liner can create quality defects in the product, such as kinks and ridges in the plastic liner. This assembly method of the current designs also inhibits optimization of the plastic liner thickness. The distortional stresses placed on the inner liner requires that it be formed of a thicker gauge plastic than would be required if its distortion during the assembly process did not occur.

SUMMARY OF THE INVENTION

A refrigerator cabinet construction is disclosed wherein the exterior cabinet has a flange extending around an open side, which flange defines a channel. A breaker strip having a first portion engageable with a flange on the inner liner has a resilient portion which is snap-fit into the channel defined in the flange of the exterior cabinet. The snap-fit construction securely holds the breaker strip attached to the cabinet, while the engagement between the breaker strip and the inner liner is such that it will accommodate a wide variance in manufacturing tolerances. At the same time, however, the breaker strip accurately aligns the liner within the refrigerator cabinet.

The use of the breaker strip which snap-fits into a flange of the exterior cabinet eliminates any requirement for distorting or deforming the inner liner during the assembly process. The elimination of such distortion enables the optimization of the inner liner thickness for cost reduction purposes, while at the same time eliminating the quality defects of the known cabinet construction.

The breaker strip also defines a closed periphery channel which extends substantially along the entire length of the breaker strip and which is adapted to receive a magnetic door closing strip. In known fashion, the magnetic strip attracts a magnetic gasket seal attached to the refrigerator door such that, when the door is closed, the magnetic gasket will seal tightly against the breaker strip even though it is formed of a plastic, non-magnetic material.

DETAILED DESCRIPTION OF THE PREFERRED EMBODIMENT

Figure 1:
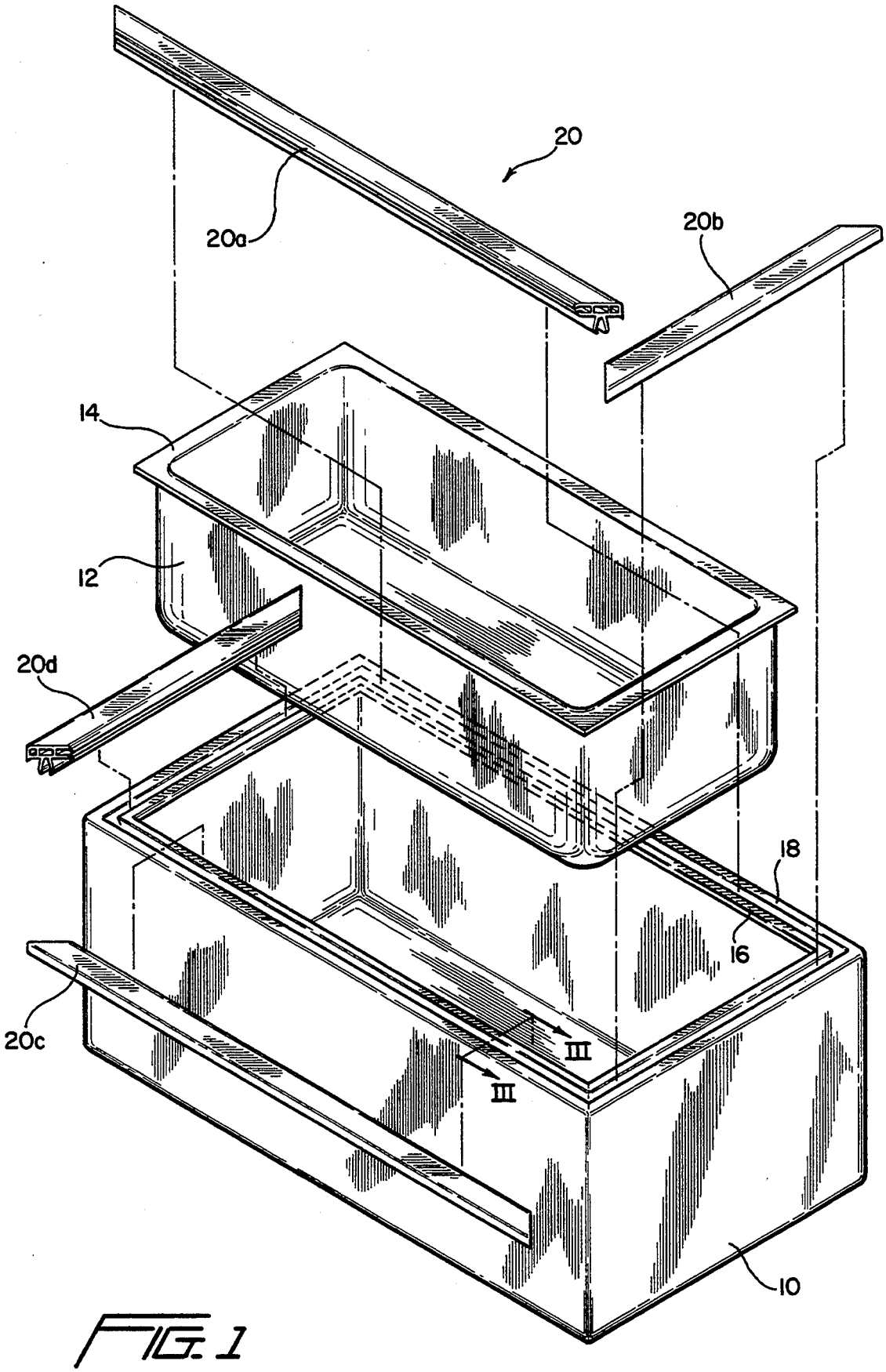
FIG. 1 is an exploded, perspective view of the refrigerator cabinet construction according to the present invention.

As best illustrated in FIG. 1, the refrigerator cabinet construction according to the present invention comprises an exterior refrigerator cabinet shell 10 which is typically constructed of sheet metal material and which defines an enclosure having one open side. Interior liner 12 is adapted to fit within the exterior cabinet 10 and is typically made of plastic material. Liner 12 defines the interior surface of the fresh food, or freezer compartment in the refrigerator cabinet and comprises an enclosure having an open side. Flange 14 extends outwardly from the front face of the liner 12 such that the flange 14 extends completely around the open face. Exterior cabinet 10 has an inwardly extending flange 16 extending around the open side. Flange 16 further defines a channel 18 which also extends around the periphery of the open side of the exterior cabinet 10. As can be best seen in FIG. 3, channel 18 has an open side facing outwardly from the flange 16 and may have a generally trapezoidal cross-sectional configuration.

The inner liner 12 is attached to the exterior cabinet 10 by breaker strips 20 which also serve to maintain the liner 12 spaced from the exterior cabinet 10 such that insulation material (not shown) may be placed between them. Breaker strip 20 may comprise four separate pieces extending around the peripheries of the flanges 14 and 16. The breaker strips **20*a*, 20*b*, 20*c* and 20*d*** each have identical cross-sectional configurations and may be extruded from plastic material by known techniques. The ends of each of the four individual strips may be mitered so as to accurately join with adjacent breaker strips so as to present a pleasing appearance to the finished product.

Figure 2:
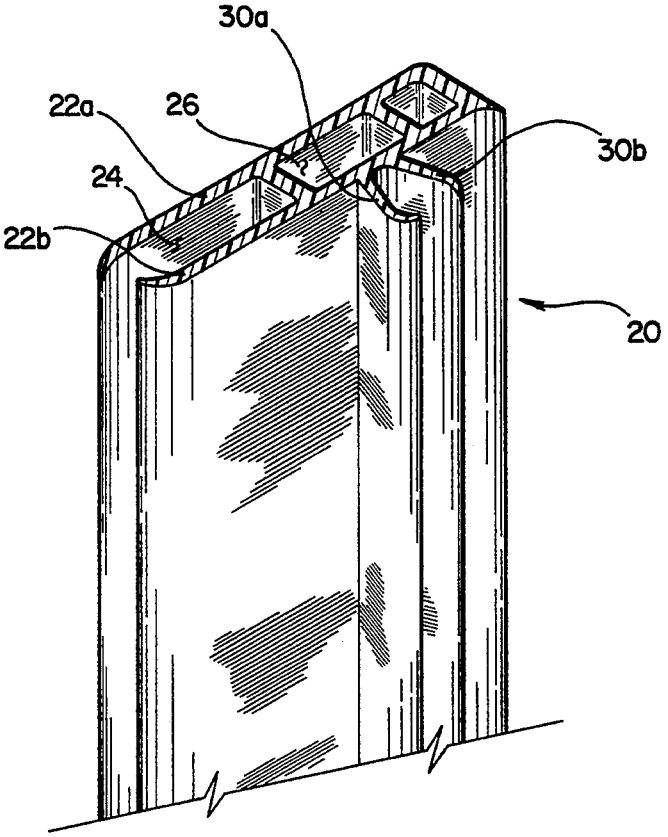
FIG. 2 is a partial, perspective view of the breaker strip utilized in the refrigerator cabinet construction illustrated in FIG. 1.
Figure 3:
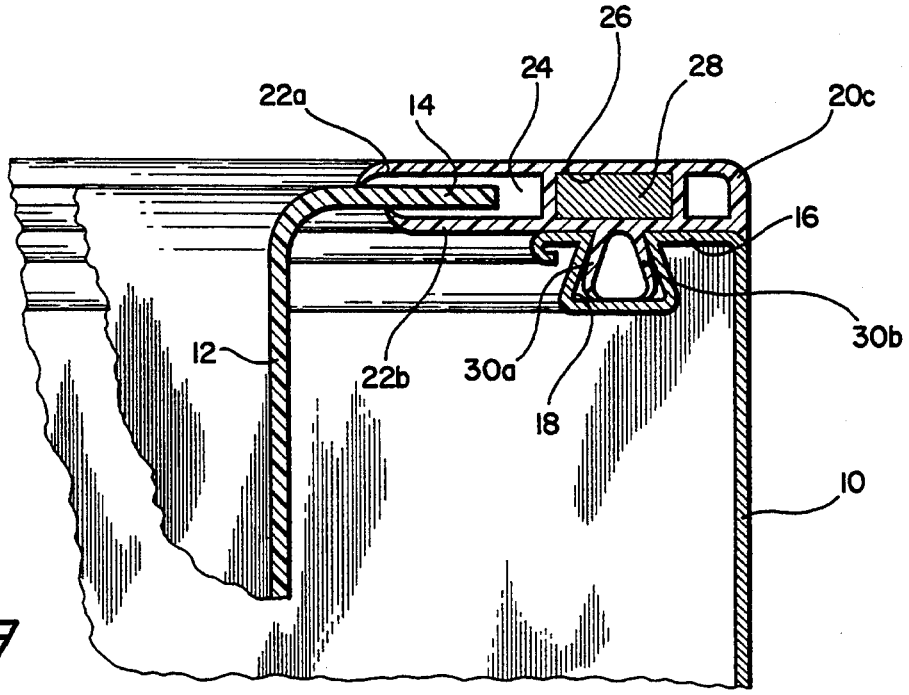
FIG. 3 is a partial, cross-sectional view of the refrigerator cabinet construction according to the present invention taken along line III—III in FIG. 1.

As best illustrated in FIGS. 2 and 3, each of the breaker strips 20 comprises a first portion having legs **22*a* and 22*b* which are spaced apart so as to define a slot 24 therebetween. The distal ends of legs 22*a* and 22*b* are spaced apart so as to enable the flange 14 of the inner liner 12 to be inserted therethrough into slot 24. As can be seen, the distal edges of legs 22*a* and 22*b* may be curved inwardly towards each other to ensure that they bear against the opposite surfaces of flange 14 so as to prevent any gaps therebetween. The length of slot 24 may be greater than the width of flange 14 to enable the slot 24** to accommodate flanges having varying manufacturing tolerances.

The breaker strip 20 has a second portion which defines channel 26 having a closed periphery and which extends substantially along the entire length of each of the breaker strips 20. Channel 26 is adapted to receive a magnetic door closing strip 28 therein. The face of the breaker strip 20 is adapted to bear against a known magnetic gasket seal attached to a door of the refrigerator cabinet. The magnetic door closing strip 28 attracts the magnetic gasket of the door into tight, sealing contact with the surface of the breaker strip 20, even though the breaker strip 20 is formed of non-magnetic material.

A third portion of the breaker strip 20 has a second pair of spaced apart legs 30*a* and 30*b*. These legs, which are formed of resilient material, diverge from each other in a direction outwardly of the breaker strip 20 so that they may snap-fit into the channel 18 formed in flange 16. As can be seen, the distal edges of legs 30*a* and 30*b* may be curved inwardly towards each other in order to facilitate their entry into the channel 18. Once snapped into place, in the flange 16, the breaker strips 20 will support and locate the liner 12 within the exterior cabinet 10.

The foregoing is provided for illustrative purposes and should not be construed as in way limiting this invention, the scope of which is defined solely by the appended claims.

I claim:

1. A refrigerator cabinet construction comprising:

a) an exterior cabinet shell having an open side and a first flange extending around the open side, the first flange defining a first channel therein;

b) an interior liner adapted to fit within the exterior cabinet and having a second flange;

c) a breaker strip interconnecting the interior liner with the exterior cabinet shell, the breaker strip comprising:

i) wall means defining a second channel having a closed periphery, the second channel extending substantially along the entire length of the breaker strip;

ii) a first pair of spaced apart legs extending from the wall means defining the second channel, the first pair of spaced apart leas defining a slot therebetween, wherein the second flange is inserted in the slot:

iii) a second pair of spaced apart legs of resilient material extending from the wall means defining the second channel, the second pair of spaced apart legs snapped into the first channel so as to be frictionally engaged therein; and, d) a magnetic door closing strip disposed in the second channel.

2. The breaker strip of claim 1 wherein both legs of the first pair of spaced apart legs are disposed at approximately 90° to both legs of the second pair of spaced apart legs.

3. The breaker strip of claim 1 wherein second pair of spaced apart legs diverge from each other in a direction extending away from the wall means defining the second channel.

4. The breaker strip of claim 3 wherein distal edges of the second pair of legs curve inwardly toward each other.

5. The breaker strip of claim 1 wherein the closed periphery channel has a generally rectangular cross-sectional configuration.

6. The refrigerator cabinet construction of claim 1 wherein the breaker strip is formed of plastic material.

* * * * *